United States Patent [19]

Teubler et al.

[11] Patent Number: 4,575,314

[45] Date of Patent: Mar. 11, 1986

[54] DEFLECTING INSERT FOR A ROTARY VANE PUMP

[75] Inventors: Heinz Teubler, Friedrichsdorf; Heinz W. Krüger, Wilhelmsdorf; René Schulz, Neu-Anspach, all of Fed. Rep. of Germany

[73] Assignee: Vickers Systems GmbH, Homburg, Fed. Rep. of Germany

[21] Appl. No.: 609,290

[22] Filed: May 11, 1984

[30] Foreign Application Priority Data

May 14, 1983 [EP] European Pat. Off. ..... 83104769.1

[51] Int. Cl.[4] ..... F04B 49/02; F04C 15/02

[52] U.S. Cl. ..... 417/310

[58] Field of Search ..... 417/310; 239/591, DIG. 19

[56] References Cited

U.S. PATENT DOCUMENTS

| | | | |
|---|---|---|---|
| 2,880,674 | 4/1959 | Klessig et al. | 417/310 X |
| 4,168,033 | 9/1979 | von Bernuth et al. | 239/591 X |
| 4,470,768 | 9/1984 | Konz | 417/310 |

*Primary Examiner*—Richard E. Gluck

*Attorney, Agent, or Firm*—Barnes, Kisselle, Raisch, Choate, Whittemore & Hulbert

[57] ABSTRACT

In a rotary vane pump having a normally vertical suction feed flow passage (17*a*, 17*b*) which opens tangentially into a horizontal, elbow-bent feed passage (18*a*, 18*b*) and a discharge passage (19*a*, 19*b*), the direction-changing portion is formed by a plug-like insert (51) which is pressed into a stepped bore (61). The insert (51) comprises erosion-resistant material.

6 Claims, 6 Drawing Figures

DEFLECTING INSERT FOR A ROTARY VANE PUMP

Figure 1:
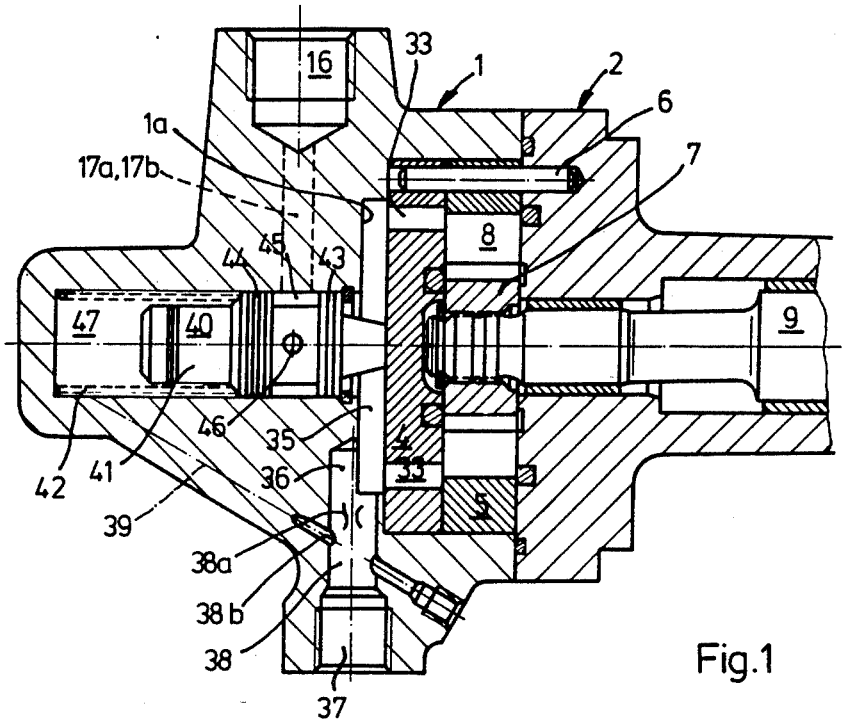

The invention relates to a rotary vane pump and particularly to a kind for steering assistance.

In a rotary vane pump of that kind U.S. Pat. No. 4,470,768, there are feed passages or ducts which extend from an oil storage chamber to the working chambers and which each have a normally perpendicular section and a normally horizontal, elbow-bend section which extend in the axial plane of the rotor and which communicate with their axial limb portions with flow division chambers to the working chambers and with their radial limb portions with a valve chamber from which the hydraulic fluid flows, when the regulating valve of the pump responds. The feed passages are substantially symmetrically formed and arranged. In the illustrated embodiment, the elbow-bend sections of the feed passages were produced by a casting process.

The production of a bend involves a high level of expenditure in a die casting process. It is less expensive to form intersecting bores in a housing which consists of an aluminum die casting, closing off portions of the bores by plugs, and in that way producing the elbow-bend portion of each feed passage (US-A-No. 2 880 674). With that mode of operation however, there are substantial flow losses in an elbow-bend portion. If the end of the plug is shaped with a configuration which leads to the expectation of an improved change in the direction of the flow, there is the danger of erosion, more specifically, because, when the hydraulic fluid flows away from the valve, very high jet flow speeds may occur, which result in plug portions being so-to-speak washed away or eroded.

The object of the present invention is therefore to design a rotary vane pump of the kind set forth in the opening part of this specification, in such a way as to provide for a good change in the direction of flow of the hydraulic fluid in the region of the elbow-bend portion, with the danger of erosion being eliminated.

With the present invention, erosion is avoided by a plug-like insert being thicker than the feed passage in the region of the elbow-bend portion, and so-to-speak lining the feed passage. If the housing comprises an aluminum die casting, brass or another material which suffers from little erosion is used for the plug-like insert. The transition between the portion of the feed passage which is formed by the wall of the aluminum die casting and the elbow-bend portion which is formed by the plug-like insert is arranged at a position which is not affected by the jet of hydraulic fluid flowing away from the valve.

Desirably, the plug-like insert extends as far as the feed passage which comes from the tank and in which underpressure is present when the valve responds. In other words, the first or front step of the stepped bore intersects the suction feed passage. The front end of the plug-like insert is accessible for a special adapted machining operation so that the flow conditions at the transition between the discharge passage of the valve and the suction flow passage and on into the curved feed passage can be adapted to a wide range of operating conditions.

It is also possible to use a shorter plug-like insert. In that case however, by virtue of the configuration of the valve, care must be taken to ensure that the jet of hydraulic fluid which flows away from the valve is directed as parallel as possible to the axis of the discharge passage, that is to say, it only impinges on the wall of the passage in the elbow-bend portion.

Figure 2:
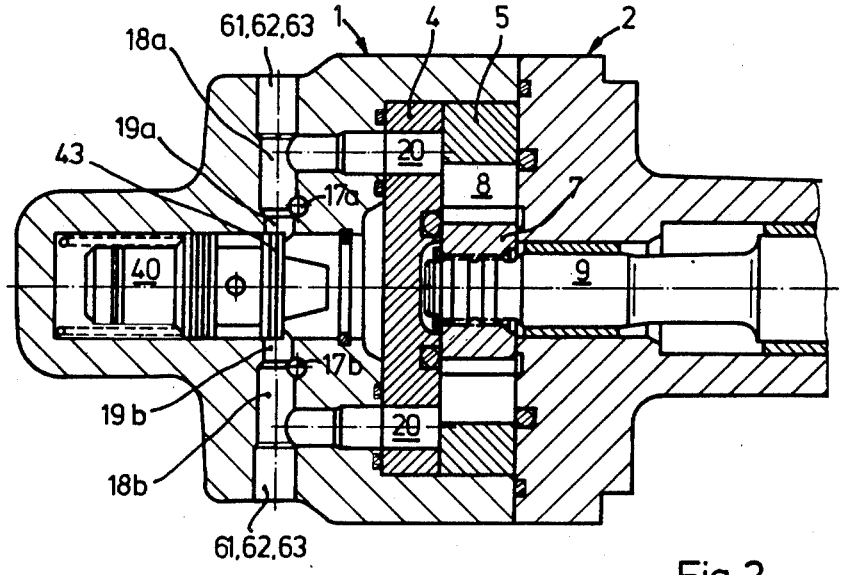
Figure 3:
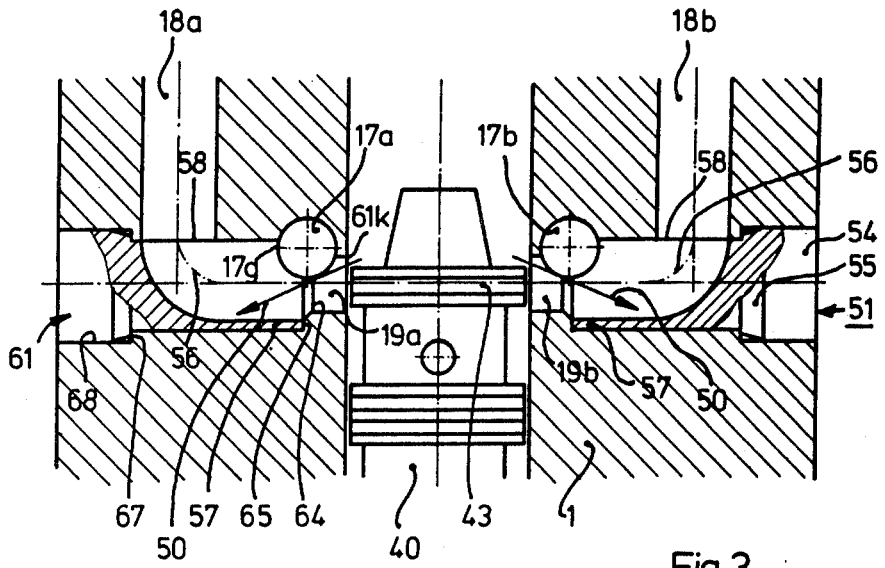
Figure 4:
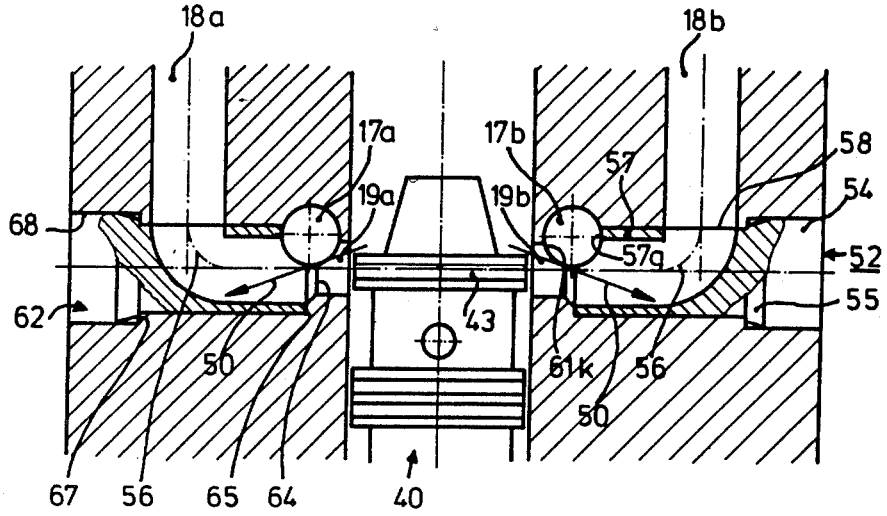
Figure 5:
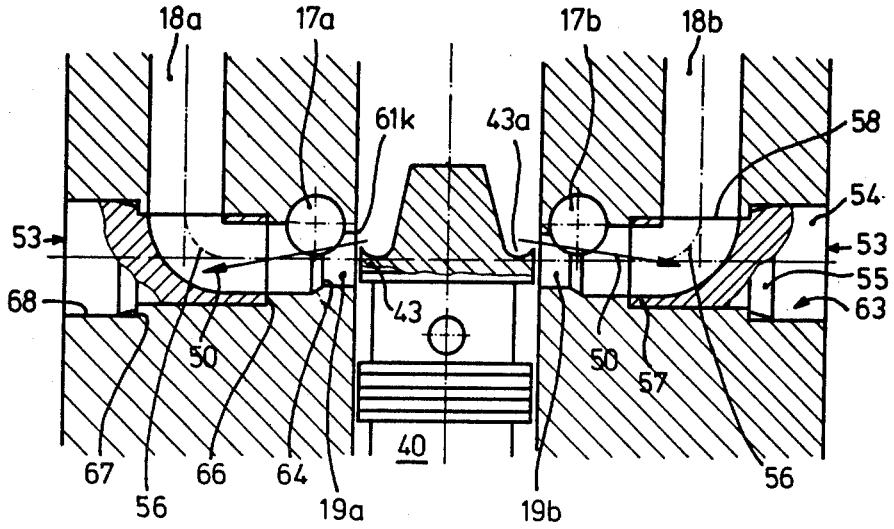
Figure 6:
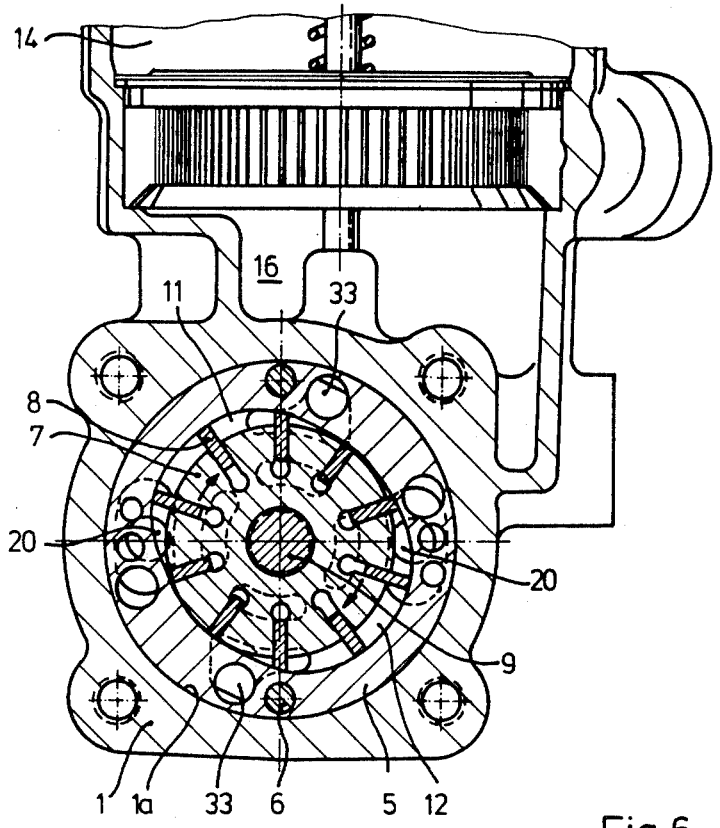

Embodiments of the invention will now be described with reference to the drawings in which:

FIG. 1 shows a view in vertical longitudinal section through a steering assistance pump, FIG. 2 shows a view in horizontal section, FIG. 3 shows a possible detail from FIG. 2 on an enlarged scale, FIG. 4 shows another possible detail, FIG. 5 shows a third possible configuration of the detail, and FIG. 6 is a view in vertical section through the pump.

The rotary vane pump comprises a main housing portion 1 and a housing cover 2 which comprise aluminium die casting, and which fluid-tightly enclose an internal cavity or chamber 1*a*. Disposed in the chamber 1*a* and fixed with respect to the housing are a pressure plate 4 and a cam ring 5 which are secured against rotary movement by pins 6. Disposed within the ring 5 and between the cover 2 and the pressure plate 4 is a rotor 7 which has a series of radial guide slots. Blades or vanes 8 are radially displaceably mounted within the guide slots. The rotor 7 can be driven by means of a shaft 9 which is mounted in a mounting bore in the cover 2. The rotor 7 is of a cylindrical shape while the ring 5 has an approximately oval internal configuration, the short axis thereof approximately corresponding to the diameter of the rotor 7 while the large axis determines the length of extension movement of the vanes 8. In that way, two sickle-shaped working areas 11 and 12 are formed between the cam ring 5 and the rotor 7, the working areas 11 and 12 being divided by the vanes 8 into a number of cell chambers. The cell chambers increase in size on the suction side of the system while they decrease in size on the pressure side.

The feed of hydraulic fluid is from a tank 14 into a distribution chamber 16 from which two substantially vertical bores extend, as feed passages or ducts 17*a* and 17*b*, and tangentially meet elbow-bend feed passage portions or sections 18*a*, 18*b*, wherein the passage portions or sections 18*a* and 18*b* are arranged in the normally horizontal axial plane of the pump and symmetrically relative to each other. The elbow-bend passage portions 18*a* and 18*b* each have a radial limb portion which communicates with a discharge passage 19*a* and 19*b* respectively, while the axial limb portions communicate with through apertures 20 in the pressure plate 4. The through apertures 20 serve to provide for the feed of hydraulic fluid into the respective working chambers of the pump.

The hydraulic fluid is discharged by way of passages 33 through the pressure plate 4 on the rear thereof into a pressure chamber 35 and from there by way of a delivery passage 36 to an external pump outlet port 37. Disposed in the passage 36 is a throttle member 38 having a delivery throttle orifice 38*a* and an auxiliary throttle 38*b*. The auxiliary throttle 38*b* communicates by way of a passage 39 with the spring chamber 47 of a flow control valve 40. The latter has a spool 41 which is urged by the force of a spring 42 in a direction towards the rear of the pressure plate 4. The spool 41 has two collar-like sealing land regions 43 and 44 between which extends an annular groove 45. When the valve 40 is in the closed condition, the discharge passages 19*a* and 19*b* communicate with the annular groove 45. A passage 46 which extends partly radially and partly axially leads from the annular groove 45 through the spool 41 into the valve chamber 47, and the passage 46 is controlled by a cone valve which, when a given permissible pressure in the valve chamber 47 is exceeded, responds and vents that chamber so that the spool 41 acts as a controlled pressure limiting valve, as is known. Whether acting as a flow control valve or as a pressure limiting valve, when it responds, the valve 40 occupies the position shown in FIG. 2.

In that arrangement, a gap is left free between the collar or land 43 on the spool and the edge of the passage 19*a* or 19*b* respectively. A vigorous jet of hydraulic fluid as indicated at 50 (see FIGS. 3 through 5) shoots through the abovementioned gap, depending on the pressure of the hydraulic fluid in the pressure chamber 35. The jet 50 normally goes at an inclined angle past the mouth opening of the feed passage 17*a* or 17*b* respectively so that at that location there is a suction effect which causes hydraulic fluid to be sucked on from the tank. However, the jet 50 also has the unacceptable characteristic of causing erosion of the wall material at the point of impingement thereof. The conventional aluminium die casting material for mounting housings in particular is sensitive to cavitation erosion. Therefore, the present invention provides that the point of impingement of the jet is clad or lined with erosion-resistant material, made for example from brass (in particular material No. 20550), bronze or steel.

More specifically, the arrangement provides a plug-like insert 51 (see FIG. 3), 52 (see FIG. 4) or 53 (see FIG. 5) which is to be fixed in an associated stepped bore 61, 62 or 63 respectively. Each stepped bore 61, 62 and 63 has a front step 64, a middle step 65 or 66 and a rearward step 67 from which there extends an outer bore portion or section 68 which, as viewed from the valve 40, is disposed radially outwardly of the elbow-bend feed passages 18*a* and 18*b* respectively. The inserts 51, 52 and 53 each have a pressing shoulder 54 with a conically tapered portion 55 in order to introduce it into the bore portion 68 and hold it by a press fit therein. Disposed in the middle part of the insert, and extending over a quarter of a circle, is a toric direction-changing portion or section 56 at which the flow of fluid is changed in direction between the radial and axial limb portions of the elbow-bend feed passage 18*a* and 18*b* respectively.

In the embodiment shown in FIG. 3, the front steps 64 and 65 are arranged adjacent the middle of the respective feed passage 17*a* and 17*b*, that is to say, the plug-like insert 51 has a front end portion 57 which is extended inwardly by a very great distance and which is cut away in the region of the flow passage 17*a*, 17*b* in order not to impede the flow of hydraulic fluid. The direction-changing passage is in the form of a laterally open groove which extends in the axial direction of the insert 51 at the end 57 and which is in the form of a torus at the end 58. A groove of that kind can be easily produced with a spherical cutter. As can be seen from FIG. 3, the diameter of the discharge passage 19*a* and 19*b* is less than the depth of the groove in the insert 51, that is to say, even when the valve 40 is in a position of substantial opening, the jet 50 of hydraulic fluid or a corresponding flow does not impinge against the ridge or burr 17*g* between the stepped bore 61 and the feed passage 17*a* or 17*b* respectively; such impingement would give rise to difficulties. The edge 61*k* at the entry of the stepped bore 61 into the valve bore covers the passage 17*a* or 17*b* to beyond the centre thereof, while the ridge or burr 17*g* exposes the passage 17*a* or 17*b* to beyond the centre.

FIG. 4 also shows an insert 52 which extends inwardly by a substantial distance and the front end 57 of which is of a similar configuration to the insert shown in FIG. 3. However, the direction-changing passage is not laterally open but is bored, a kind of toric cavity being formed by means of a spherical cutter. That is possible for the reason that the end 58 of the direction-changing passage, which is towards the pump, is readily accessible and a spherical cutter can be guided along a curve when it moves into the insert 52 to be produced. At the other end, the ridge or burr 57*g* may be conveniently rounded off in order to reduce the risk of eddying. The rounded-off ridge 57*g* is disposed approximately in the radial central plane of the feed passage 17*a* or 17*b* respectively.

The insert 53 shown in FIG. 5 is somewhat shorter and has a bored direction-changing passage which is produced in a similar fashion to the construction shown in FIG. 4. The point of transition between the insert 53 and the die cast material of the housing of the pump at the step 66 is particularly exposed to erosion; for that reason, care is taken to ensure that the jet 50 of hydraulic fluid does not occasionally impinge at that point. For that purpose, the collar or land portion 43 has an undercut configuration as indicated at 43*a* being of a concave configuration in order to deflect the jet, in conjunction with the edge 61*k*. The jet 50 of hydraulic fluid is directed substantially more strongly parallel to the local axial direction of the passage 19*a* or 19*b* than is the case in the embodiment shown in FIG. 3 or FIG. 4. Therefore, the jet 50 impinges on the wall of the insert 53 at a substantially later stage, virtually in the region of the curve of the direction-changing passage.

The insert 51 is preferably produced by cold forming while the inserts 52 and 53 are preferably bored and milled in combination, insofar as regards the production of the direction-changing passage. The housing 1 which preferably comprises aluminium may also be produced by a chill mould casting process, instead of by die casting.

We claim:

1. A rotary vane pump comprising a housing having a cavity therein, a pressure plate having inlet and outlet openings, a cam ring also having inlet and outlet openings, a rotor having slots, a plurality of vanes, at least a vane being in each slot, a shaft being journalled in said housing and drivingly connected to that rotor, a valve, a tank and a pump outlet, cell chambers being comprised in said cavity between said pressure plate, said cam ring, said rotor and said vanes, wherein at least one cell chamber is contracting and another cell chamber is expanding, that housing having inlet passageways leading from said tank to said expanding cell chamber, and outlet passageways leading from said contracting cell chamber to said pump outlet, said inlet and outlet passageways also being connected to said valve, said inlet passageways including a pair of normally vertical feed passages and a pair of normally horizontal elbow-bend feed passages, each connected to a discharge passage which is opened and closed by said valve, which when open will produce each a fluid jet into said elbow-bend feed passages, the improvement wherein said elbow-bend feed passages each comprises a stepped bore and a plug-like insert being made up from an erosion-resistant material fixed in said stepped bore and including a fluid deflection means, wherein said valve has a land which is undercut so as to produce, in cooperation with said discharge passage, a fluid jet which is directed essentially in longitudinal direction of said insert.

2. A rotary vane pump set forth in claim 1 wherein said stepped bores each has an outer bore portion and each said insert has a shoulder pressed in said outer bore portion.

3. A rotary vane pump set forth in claim 1 wherein each said insert has an end which contacts said vertical feed passage.

4. A rotary vane pump set forth in claim 1 wherein each said fluid deflection means is a quarter-circle torus.

5. A rotary vane pump set forth in claim 4 wherein each said insert has a laterally open groove connected to said torus.

6. A rotary van pump set forth in claim 1 wherein each said stepped bore has three steps.

* * * * *